US006367953B1

(12) United States Patent
Lee

(10) Patent No.: US 6,367,953 B1
(45) Date of Patent: Apr. 9, 2002

(54) LIGHTING DECORATION WITH AN INNER LIGHT BULB STRING

(76) Inventor: Hung-Wen Lee, No. 188, Shien Cheng 2nd Road, Chupei, Hsinchu Shien (TW)

( * ) Notice: Subject to any disclaimer, the term of this patent is extended or adjusted under 35 U.S.C. 154(b) by 0 days.

(21) Appl. No.: 09/756,276

(22) Filed: Jan. 9, 2001

(51) Int. Cl.[7] ..... F21S 13/00

(52) U.S. Cl. ..... 362/252; 362/240; 362/249; 362/431; 362/806

(58) Field of Search ..... 362/240, 249, 362/252, 396, 431, 806

(56) References Cited

U.S. PATENT DOCUMENTS 4,335,422 A * 6/1982 Van Ess ..... 362/249
4,930,055 A * 5/1990 Swadell ..... 362/806

* cited by examiner

*Primary Examiner*—Stephen Husar
(74) *Attorney, Agent, or Firm*—Rosenberg, Klein & Lee

(57) ABSTRACT

The present invention relates to a lighting decoration with an inner light bulb string, wherein the lighting decoration includes a long pipe-type transparent body to receive the light bulb string therein. The body is capable of being easily fixed on the ground in the garden or the like for an assembled lighting decorative effect. And it uses a novel connecting structure to receive the light bulb string in the body securely and conveniently.

1 Claim, 3 Drawing Sheets

LIGHTING DECORATION WITH AN INNER LIGHT BULB STRING

BACKGROUND OF THE INVENTION

In order to provide various decorative effects, it is known that there are various configurations of lighting decorations being provided in the garden or other outdoor places. Always, a prior art lighting decoration includes a supporting rod fixed on the ground and a bulb with a lampshade being connected on the top of the rod. It provides different outlooks only by replacement of another various lampshade.

The primary object of the present invention is to provide a novel structure of a lighting decoration, which can be used outdoors and obtains a better decorative effect. Now the features and advantages of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
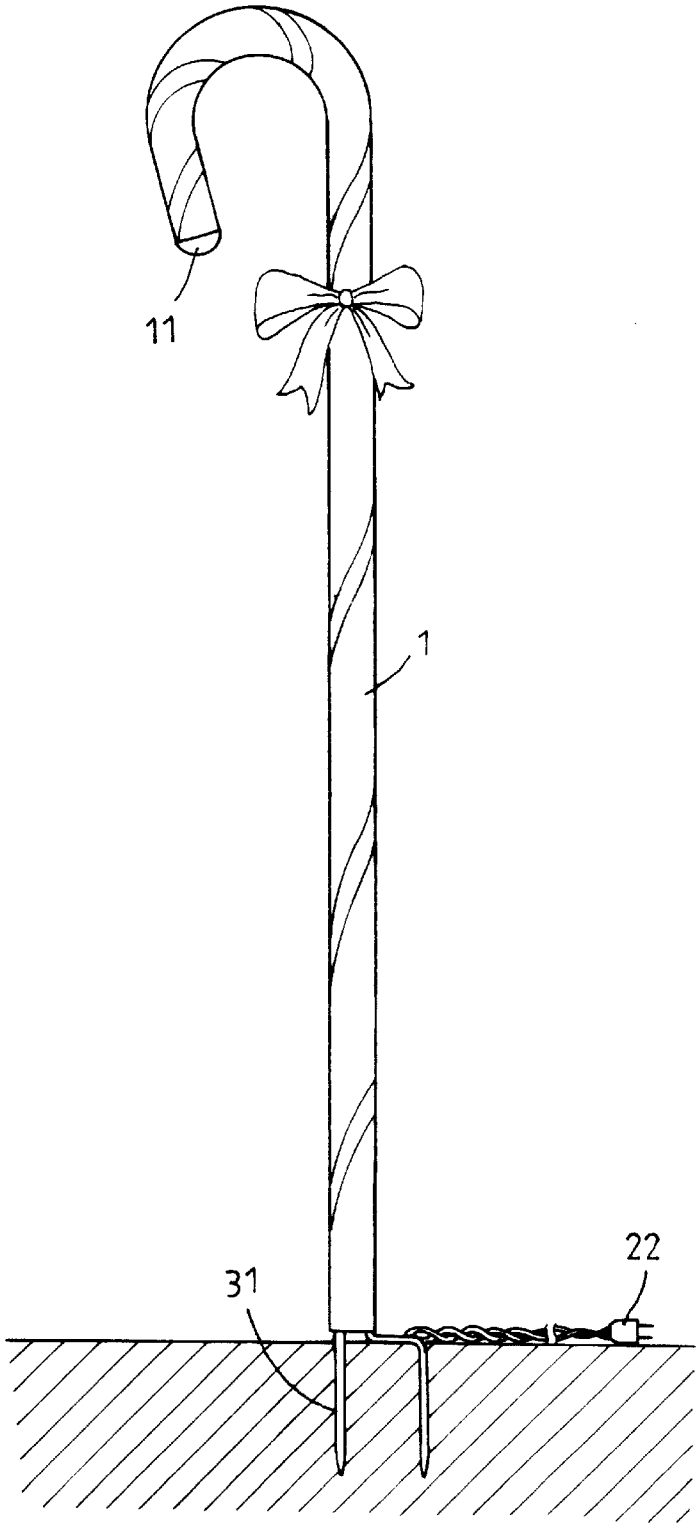
FIG. 1 is a plan view of a lighting decoration according to the present invention fixed on the ground.
Figure 2:
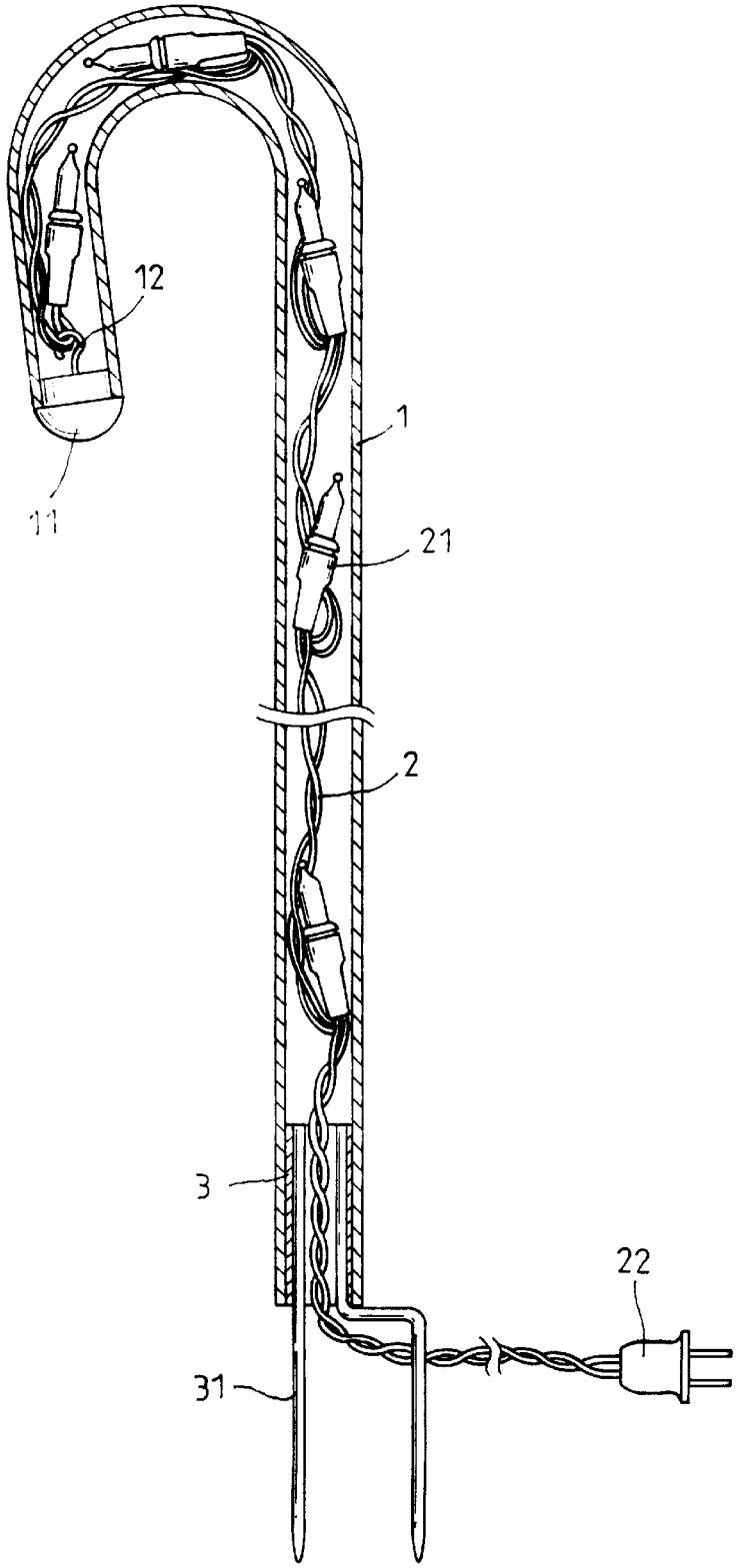
FIG. 2 is a cross-sectional view of the lighting decoration of FIG. 1 according to the present invention.
Figure 3:
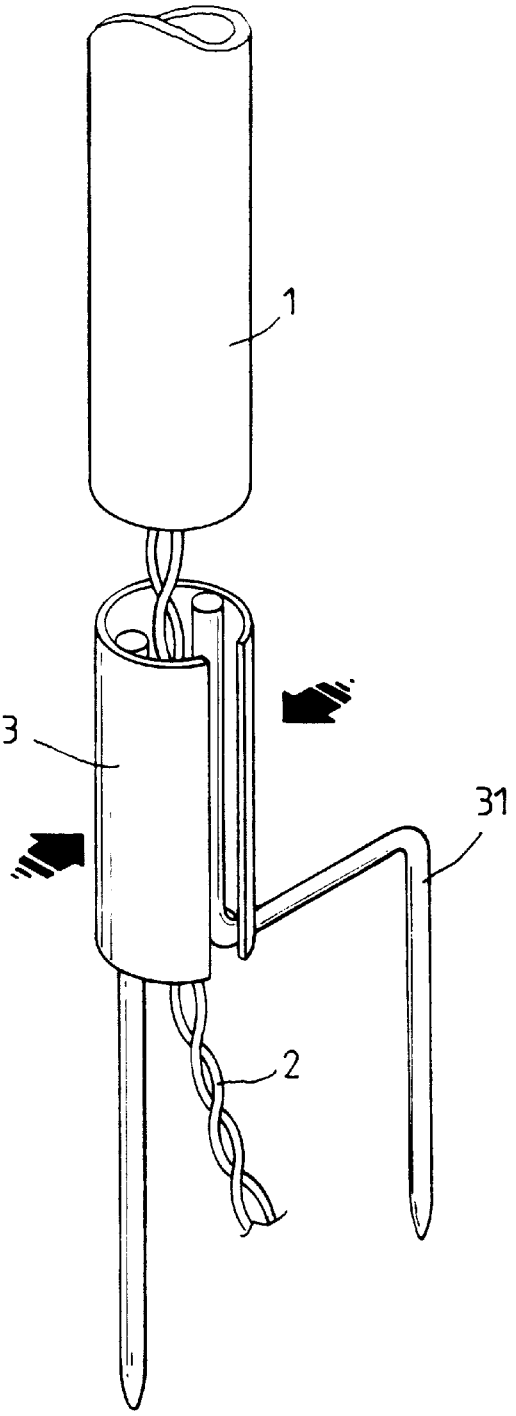
FIG. 3 is a perspective view showing parts of the lighting decoration of this invention.

Referring to the appended figures of this invention, it can be seen that the present invention includes a long pipe-type body (1), which is made of transparent material. A cap (11) with an inner hook (12) is provided on an upper end of the body (1). A light bulb string (2) is extended in the pipe-type body (1) and has its end connected with the hook (12) of the cap (11). The bulbs (21) of the string (2) are separately mounted in the body and a plug (22) on the other end of the string (2) is extended outwards from the bottom end of the body (1). An elastic C-type sleeve (3) having a pair of sticks (31) can be compressed and received in the bottom end of the body (1) to obtain a perfect engagement therein because of the elastic force.

Under the combination as above mention, the whole lighting decoration is capable of being fixed on the ground by inserting the sticks (31) into the earth. The long pipe-type body (1) is thus mounted at any desired position in the garden in ease. By use of a plurality of the lighting decorations of the present invention, a specific drawing, such as a passing way or a decorative configuration, can be easily completed. When the bulbs (21) of the string (2) in lightened, the decorative lighting body (1) with light transparently provides special decorative lighting effect.

Moreover, since the string (2) can be connected with the hook (12) of the cap (11), the assembly of the string (2) within the body (1) is more convenient and secure. The use of the C-type sleeve (3) is also very easy for being fixed on the ground with obvious improvement. Evidently the invention has the essence of a patent. We hereby apply for a patent grant.

What is claimed is:

1. A lighting decoration with an inner light bulb string including a long pipe-type body, which is made of transparent material, a cap with an inner hook being provided on an upper end of the body, a light bulb string extended in the pipe-type body and having its end connected with the hook of the cap; and the bulbs of the string being separately mounted in the body while a plug on the other end of the string extended outwards from the bottom end of the body, and an elastic C-type sleeve having a pair of sticks being compressed and received in the bottom end of the body to obtain a perfect engagement therein because of the elastic force.

* * * * *